United States Patent [19]

Heeren

[11] Patent Number: 4,973,265

[45] Date of Patent: Nov. 27, 1990

[54] DISMOUNTABLE COAXIAL COUPLING

[75] Inventor: Johannes P. A. Heeren, Etten-Leur, Netherlands

[73] Assignee: White Products B.V., Oudenbosch, Netherlands

[21] Appl. No.: 383,374

[22] Filed: Jul. 20, 1989

[30] Foreign Application Priority Data

Jul. 21, 1988 [NL] Netherlands ..... 8801841

[51] Int. Cl.[5] ..... H01R 13/00

[52] U.S. Cl. ..... 439/584

[58] Field of Search ..... 439/578–585

[56] References Cited

U.S. PATENT DOCUMENTS

| | | | |
|---|---|---|---|
| 4,037,909 | 7/1977 | Trompeter et al. | 439/584 |
| 4,331,374 | 5/1982 | Phillips | 439/584 |
| 4,441,781 | 4/1984 | Forney, Jr. et al. | 439/584 |
| 4,456,323 | 6/1984 | Pitcher et al. | 439/584 |

*Primary Examiner*—Joseph H. McGlynn
*Attorney, Agent, or Firm*—Pennie & Edmonds

[57] ABSTRACT

A dismountable coupling 1, which can be assembled in a simple manner and in a short period of time is provided for coupling coaxial cables.

The coupling 1 having clamping means which include at least one pair of sockets (16, 17) with a contact socket 17, to be provided on the freed end of the cable between an inner conductor 9 and a coaxial outer conductor 10 of the cable and with a conical conductive clamping socket 16 to be provided round the outer conductor 10.

The contact socket 17 being provided with circumferential teeth 18 extending radially outwards. In a special embodiment the coupling 1 has a conductive cylindrical adapter 20 with dimension to be chosen such that various cables can be connected while using the same housing 2 of the coupling 1.

20 Claims, 2 Drawing Sheets

DISMOUNTABLE COAXIAL COUPLING

BACKGROUND OF THE INVENTION

The invention relates to a high frequency coupling for coupling two coaxial cables, said coupling being assembled of a cylindrical housing with two open ends, whereby the respective cables in the open ends in question can be connected together in the housing by means of clamping means.

Such a high frequency coupling is generally known and is used in networks and systems for transmitting high frequency signals. More particularly data-processing systems can be considered here, such as computer and telephone networks, as well as professional high frequency systems, such as community antenna systems. In the various systems the transmission of high frequency signals usually takes place via underground coaxial cables. These may for example be of the well-known type: Sas, Sas Slimline or Bamboe. In some places these underground cables, stiff and not very easy to handle, have a fixed connection to an aboveground high frequency processing unit.

Such a fixed connection has quite a few disadvantages. Not only is the exchange of a processing unit, possibly defective or in need of replacement, made more difficult, but moreover it appears that, due to temperature and weather influences and due to subsidence of the ground, the length of the underground cable varies a few centimeters, dependent on the circumstances. In order to overcome these drawbacks the introduction of a high frequency coupling between the coaxial underground cable and a coaxial cable coming from the processing unit may be considered. In practice, however, it appears that such a high frequency coupling must meet a whole range of stiff requirements. A few instances are:

the high degree of reproducibility and constant quality required in particular of professional systems, both with regard to the electrical and with regard to the mechanical properties of the coupling. With regard to the electrical properties a good permanent connection between the respective inner and outer conductors of the coaxial cables is most important, as well as good high frequency transmission properties coupled to low frequency radiation losses over a wide frequency range to approximately 1 GHz. With regard to its mechanical properties the coupling must be made of materials which preserve their mechanical strength for a long time and under changing circumstances. In particular these materials also need to be resistant against acids, salts and moisture present in and near the ground;

furthermore it is important that the coupling can be mass produced in a simple manner at a low cost price;

it must be possible for the coupling to be provided at the work station by the average skilled worker, without any laborious activities such as soldering;

it is especially important that the coupling is resistant against extreme weather conditions and that it is furthermore unconditionally watertight for a long time under these changing circumstances; and furthermore the coupling must meet all the requirements made by the various inspection authorities at home and abroad.

SUMMARY OF THE INVENTION

The object of the invention is to provide a dismountable coupling which can be assembled in a simple manner and in a short space of time, and which furthermore meets all the stiff requirements mentioned above.

In order to accomplish that objective the high frequency coupling according to the invention is characterized in that the clamping means include at least one pair of sockets, said pair of sockets having a contact socket, to be provided on a freed end of the cable, between an inner conductor and an outer conductor of the cable extending coaxially relative to the inner conductor, and a conical conductive clamping socket to be provided around the outer conductor, and that the clamping means include a tightening nut which, by being screwed into the open end of the housing, squeezes the clamping socket on the outer conductor of the cable which is supported by the contact socket.

In the high frequency coupling according to the invention a permanent electrical contact is in particular ensured between the outer conductor of the cable and the housing of the coupling, and at the same time the internal end of the inner conductor of the cable is protected, whilst also the outer conductor of the cable is supported.

One embodiment of the high frequency coupling according to the invention is characterized in that the contact socket is provided with teeth, extending radially outwards, which are mounted on its circumference.

The use of the teeth not only enhances the mechanical strength of the freed end of the cable, but at the same time secures the contact socket in said end, between the inner and the outer conductor of said cable.

Another embodiment of the high frequency coupling according to the invention is characterized in that the clamping means include a conductive cylindrical adapter having two open ends, whereby the first end of the adapter is provided with screw thread which corresponds with screw thread provided on the second end of the housing, and whereby the second end of the adapter is provided with screw thread which corresponds with screw thread provided on the tightening nut, that a narrowing conical surface is provided in the adapter, said conical surface, by co-operating with the conical terminal socket, exerting the clamping force to be directed radially inwards on the outer conductor when the tightening nut is provided on the adapter, and that an insulating insert is provided between the contact socket and the adapter.

The advantage of the high frequency coupling according to the invention is that by using the adapter the coupling has become universal, i.e. that by selecting the internal dimensions of the adapter and the dimensions of the pair of sockets various cables can be connected while using the same housing of the coupling.

Another embodiment of the high frequency coupling according to the invention is characterized in that the contact socket has an upright edge, which is to project beyond the freed end of the cable, said upright edge in the assembled condition of the coupling butting against a cam edge provided in the adapter.

The advantage of the coupling according to the invention is that the centering and the retaining of, in particular, the end of the cable have been further improved, since they have become even more accurate.

The invention will be further explained with reference to the drawing, in which corresponding reference numbers indicate corresponding elements.

DETAILED DESCRIPTION OF THE DRAWINGS

Figure 1:
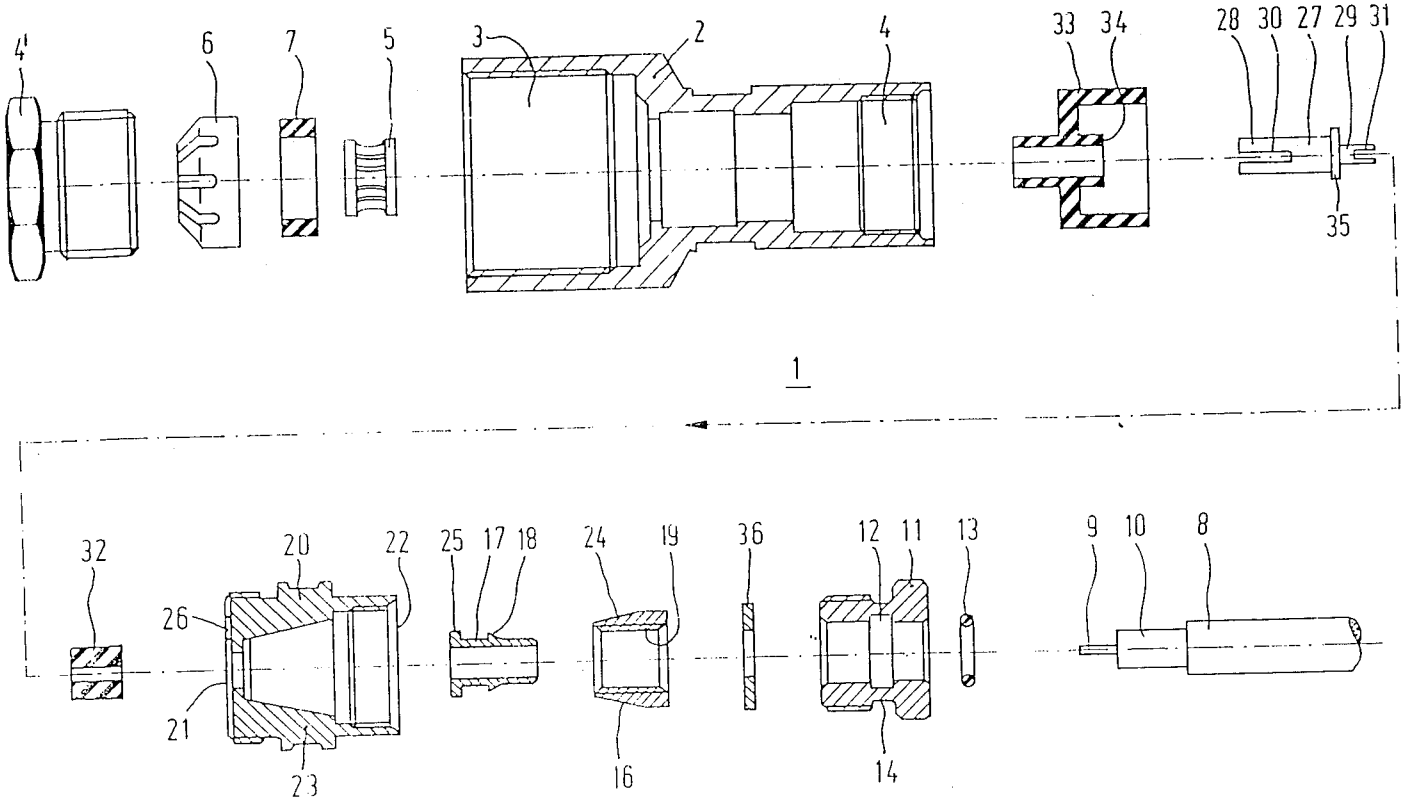
FIG. 1 is an exploded view of the high frequency coupling according to the invention.
Figure 2:
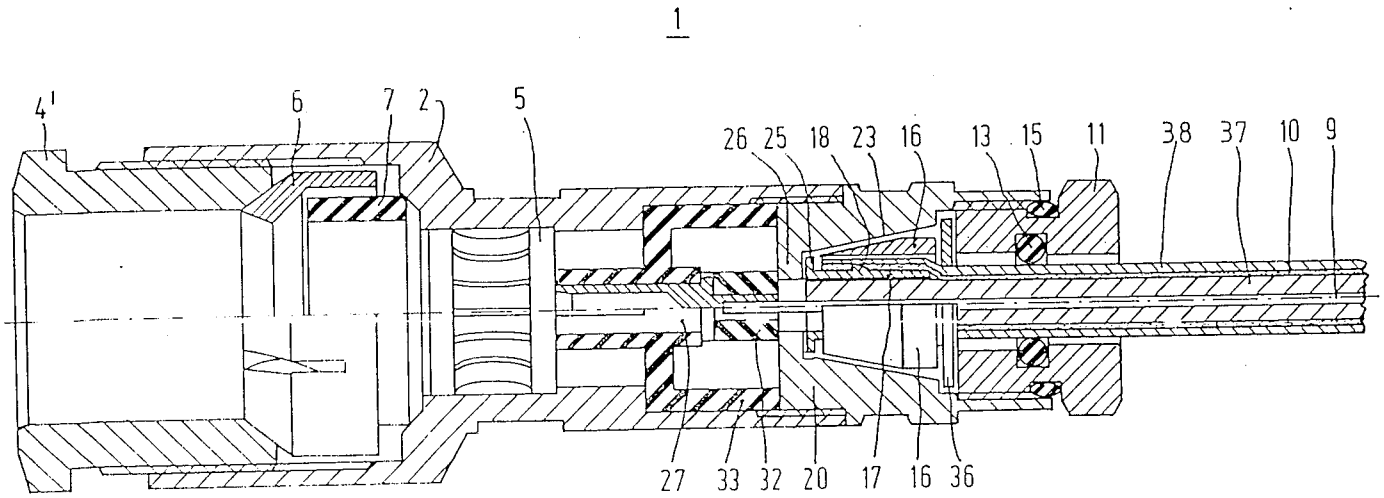
FIG. 2 shows the high frequency coupling of FIG. 1 in the assembled condition.

The FIGS. 1 and 2 show a dismountable coaxial coupling 1. The coupling 1 has a cylindrical housing 2 with two open ends 3 and 4. The first open end 3 is provided with screw thread, which corresponds with the screw thread provided on a tightening nut 4'. In the open end 3 a usually heavy and stiff underground cable is provided. A finned ring 5 is provided round the coaxial outer conductor of said cable, which is freed at its end. A plastic clamping ring 6 and a ring 7, usually made of rubber, are also slipped around the sheath of the coaxial cable. The assembly is slid into the open end 3, after which the tightening nut 4' is screwed down. When the tightening nut 4' is screwed down the plastic clamping ring 6 presses down on the sheath of the coaxial cable and presses it into the housing 2. The waisted finned ring 5 is staved up as a result, thus making contact with the outer conductor of the coaxial cable and with the conductive housing 2 of the coupling 1. Dependent on the type of coaxial cable which is used the shape of the clamping ring 5, the ring 7 or the clamping ring 6 may be adapted. The clamping ring 5 e.g. may also be fixed in the coupling 1.

At the second open end 4 of the housing 2 a usually flexible coaxial cable 8 is provided. The coaxial cable 8 has an inner conductor 9 and an outer conductor 10. After a tightening nut 11, which may be provided with a flexible O-ring 13 at an inner peripheral edge 12 and possibly with a further flexible O-ring 15 at an outer peripheral edge 14, has been provided on the cable, a clamping socket 16 is provided around the outer conductor 10 and a contact socket 17 is provided between the inner conductor 9 and the outer conductor 10. Preferably the contact socket is provided between the dielectric 37 of the cable and the outer conductor 10 and the electrically conductive clamping socket 16 is guided across the insulation 38 of the cable 8, so that when helical teeth 19 are present on the inner surface of the clamping socket 16, said teeth not only ensure a good electrical contact, but besides an additional tension relief is obtained. The contact socket 17 may have teeth 18, extending radially outwards, on its circumference, as a result of which the outer conductor 10 is additionally pressed against the clamping socket 16 when the contact socket 17 is inserted. The clamping socket 16 will usually have a slit (not shown), which is provided in the longitudinal direction. As a result the clamping socket 16 can expand a little when being provided on the outer conductor 10 and narrow when it is screwed down into the housing 2 of the coupling 1, as a result of which an additional clamping force can be exerted on the outer conductor 10.

The coupling 1 furthermore has an adapter 20 with two open ends 21 and 22. The adapter 20 has a screw thread on the outer circumference of the first open end 21, which screw thread corresponds with a screw thread provided on the inner circumference of the second open end 4 of the housing 2. On the second open end 22 of the adapter 20, on the inner surface, there is provided a screw thread, which corresponds with an outer screw thread on the tightening nut 11. The adapter 20 has a conical surface 23, which narrows from the second end 22 towards the first end 21. The conical surface 23 co-operates with a conical outer surface 24 of the clamping socket 16 when the tightening nut 11 is screwed down on the adapter 20.

If the adapter 20 is present the contact socket 17 is furthermore provided with an upright edge 25, which projects beyond the outer conductor 10 of the cable 8 in the assembled condition of the coupling 1, and which butts against a cam edge 26 provided in the adapter 20.

The coupling 1 has a contact socket 27 for making electric contact between the inner conductor 9 and the inner conductor of the coaxial cable to be provided in the first open end 3 of the housing 2. The contact socket 27 has two head ends 28 and 29, which are each provided with longitudinal cuts 30 and 31 along part of their length for realising a clamping contact between each of the inner conductor and the contact socket 27. If the adapter 20 is present an insulating insert 32 will furthermore be provided between the adapter 20 and the contact socket 27. The contact socket 27 is centred and supported by an insulating contact socket holder 33. The contact socket holder 33 will be provided with an upright edge 34, which in the dismounted condition of the coupling 1 butts against a peripheral edge 35 of the contact socket 27. A washer (not shown) may furthermore be provided, e.g. between the contact socket holder 33 and the adapter 20. A washer 36 is furthermore provided between the terminal socket 16 and the tightening nut 11.

I claim:

1. A high frequency coupling for coupling two coaxial cables, said coupling being assembled of a cylindrical housing with two open ends, whereby the respective cables in the open ends can be connected together in the housing by means of clamping means, characterized in that the clamping means include at least a contact socket, to be provided on a freed end of the cable, between an inner conductor and an outer conductor of the cable extending coaxially relative to the inner conductor, and a conical conductive clamping socket to be provided round the outer conductor, and that the clamping means include a tightening nut which, by being screwed into the open end of the housing, squeezes the clamping socket on the outer conductor of the cable which is supported by the contact socket, said clamping means further including a conductive contact socket, open at two opposed head ends, whose head ends are each provided with longitudinal cuts for receiving the free inner conductors of the cables in a tight fit, and further characterized in that the clamping means include a conductive cylindrical adapter having two open ends, whereby the first end of the adapter is provided with screw thread which corresponds with screw thread provided on the second end of the housing, and whereby the second end of the adapter is provided with screw thread which corresponds with screw thread provided on the tightening nut, that a narrowing conical surface is provided in the adapter, said conical surface, by co-operating with the conical clamping socket, exerting the clamping force to be directed radially inwards on the outer conductor when the tightening nut is provided on the adapter, and that an insulating insert is provided between the contact socket and the adapter.

2. A high frequency coupling according to claim 1, characterized in that the contact socket has an upright edge, which is to project beyond the freed end of the cable, said upright edge in the assembled condition of the coupling butting against a cam edge provided in the adapter.

3. A high frequency coupling according to claim 1, characterized in that the contact socket is provided with teeth, extending radially outwards, which are mounted on its circumference.

4. A high frequency coupling according to claim 3, characterized in that the clamping means include an insulating contact socket holder, to be provided in the housing, for concentrically and mechanically supporting, inside the housing of the coupling, the contact socket that electrically connects the inner conductors.

5. A high frequency coupling according to claims 1 or 3, characterized in that helical teeth are provided on the inner surface of the terminal socket, which is to be brought into contact with the outer conductor.

6. A high frequency coupling according to claims 1 or 3, characterized in that the clamping socket has a slit, which is provided in the longitudinal direction.

7. A high frequency coupling according to claims 1 or 3, characterized in that a washer is provided between the clamping socket and the tightening nut.

8. A high frequency coupling according to claims 1 or 3, characterized in that a flexible O-ring is provided in an inner peripheral edge of the tightening nut.

9. A high frequency coupling according to claims 1 or 3, characterized in that a further O-ring is provided in an outer peripheral edge of the tightening nut.

10. A high frequency coupling for coupling two coaxial cables, at least one of said cables having a free end defined by an inner conductor, a dielectric surrounding said inner conductor and an outer conductor surrounding said dielectric, said coupling including a cylindrical conductive housing with open ends, whereby the respective cables in said open ends are connectable together in said housing, and clamping means connectable to one open end of said housing for connecting said one cable to said housing, said clamping means including at least a first contact socket disposed on the dielectric of the free end of said one cable, substantially entirely between said inner conductor and said outer conductor of said free end, and a conical conductive clamping socket disposed on said outer conductor on said free end and having a conical outer surface which narrows in the direction of said free end, said clamping means further including a conductive cylindrical adapter having a first end for connection to said one open end of said housing and a second end having a narrowing conical inner surface for receiving said clamping socket, with the outer conical surface of said clamping socket engaging the inner surface of said adapter, said clamping means further including a tightening nut for connection to said second end of said adapter such that by tightening the connection of said nut with said adapter said clamping socket is forced into said adapter and a radially inwardly directed clamping force is exerted on said outer conductor.

11. A high frequency coupling according to claim 10, wherein said first contact socket has teeth mounted on its circumference and extending radially outwards.

12. A high frequency coupling according to claim 10, wherein said clamping socket has helical teeth on its inner surface.

13. A high frequency coupling according to claim 10 or claim 12, wherein said clamping socket has a slit along the longitudinal direction of the coupling.

14. A high frequency coupling according to claim 10, further comprising a washer located between said clamping socket and said tightening nut.

15. A high frequency coupling according to claim 10, further comprising a flexible O-ring mounted in an inner peripheral edge of said tightening nut.

16. A high frequency coupling according to claim 10, further comprising an O-ring mounted in an outer peripheral edge of said tightening nut.

17. A high frequency coupling according to claim 10, said clamping means further including a second conductive contact socket, having two opposed open head ends with longitudinal cuts for receiving inner conductors of the respective cables in a tight fit.

18. A high frequency coupling according to claim 17, said clamping means further including an insulating contact socket holder for concentrically and mechanically supporting said second contact socket inside said housing.

19. A high frequency coupling according to claim 17, wherein said first end of said conductive cylindrical adapter has screw thread corresponding to screw thread on said one open end of said housing, and said second end of said adapter has screw thread corresponding to screw thread on said tightening nut, and further comprising an insulating insert disposed between said second contact socket and said adapter.

20. A high frequency coupling according to claim 19, wherein said second contact socket has an upright edge projecting beyond said free end of said cable, for positioning said second contact socket against a cam edge within said adapter.

* * * * *